US005338319A

United States Patent [19]

Kaschig et al.

[11] Patent Number: 5,338,319

[45] Date of Patent: Aug. 16, 1994

[54] PROCESS FOR THE PHOTOCHEMICAL AND THERMAL STABILIZATION OF POLYAMIDE FIBRE MATERIAL WITH A COPPER COMPLEX HAVING FIBRE-AFFINITY AND AN OXALIC ACID DIARYLAMIDE

[75] Inventors: Jürgen Kaschig, Freiburg, Fed. Rep. of Germany; Gerhard Reinert, Allschwil, Switzerland

[73] Assignee: Ciba-Geigy Corporation, Ardsley, N.Y.

[21] Appl. No.: 870,650

[22] Filed: Apr. 20, 1992

[30] Foreign Application Priority Data

Apr. 26, 1991 [CH] Switzerland ..... 1252/91-2

[51] Int. Cl.[5] ..... D06M 11/38; C09B 67/00

[52] U.S. Cl. ..... 8/586; 8/181; 8/194; 8/127.6; 8/115.62; 8/115.63; 8/115.64; 8/115.65; 8/115.66; 8/550; 8/639; 8/643; 8/685

[58] Field of Search ..... 8/181, 194, 127.6, 115.62, 8/115.63, 115.64, 115.65, 115.66, 550, 586, 639, 643, 685

[56] References Cited

U.S. PATENT DOCUMENTS

| | | | |
|---|---|---|---|
| 3,529,982 | 9/1970 | Luethi . | |
| 3,542,573 | 11/1970 | Biland . | |
| 4,003,875 | 1/1977 | Liitki | 260/45.9 |
| 4,544,372 | 10/1985 | Heise | 8/602 |
| 4,655,783 | 4/1987 | Reinert | 8/115.66 |
| 4,655,785 | 4/1987 | Reinert | 8/442 |
| 4,704,133 | 11/1987 | Reinert et al. | 8/442 |
| 4,902,299 | 2/1990 | Anton | 8/442 |
| 5,045,083 | 9/1991 | Bennett | 8/442 |

*Primary Examiner*—Helen M. S. Sneed
*Assistant Examiner*—E. D. Irzinski
*Attorney, Agent, or Firm*—George R. Dohmann; Marla J. Mathias

[57] ABSTRACT

There is disclosed a process for the photochemical and thermal stabilisation of polyamide fibre material as claimed in claim 1.

The fibre materials treated by the inventive process are distinguished by good fibre affinity and enhanced photochemical and thermal stability.

20 Claims, No Drawings

PROCESS FOR THE PHOTOCHEMICAL AND THERMAL STABILIZATION OF POLYAMIDE FIBRE MATERIAL WITH A COPPER COMPLEX HAVING FIBRE-AFFINITY AND AN OXALIC ACID DIARYLAMIDE

The present invention relates to a process for the photochemical and thermal stabilisation of polyamide fibre material with a copper complex having fibre affinity and an oxalic acid diarylamide, to a composition containing these compounds and to the use of said composition for the photochemical and thermal stabilisation of polyamide fibre material.

The use of oxalic acid diarylamides in conjunction with copper compounds for producing lightfast and photochemically stable dyeings on polyamide fibres is disclosed in DE-A-4 005 014. The water-insoluble oxalic acid diarylamides used in this reference have, however, only limited fibre-affinity, poor wetfastness properties, inadequate resistance to migration, and they cannot be used in all application processes.

It has now been found that a selection of the water-soluble oxalic acid diarylamides disclosed in U.S. Pat. Nos. 3,529,982, 3,542,573 and 4,003,875 are not subject to these limitations and, surprisingly, are able to enhance further the stabilisation effects of copper complexes which are disclosed for example in U.S. Pat. No. 4,655,783.

Accordingly, the invention relates to a process for the photochemical and thermal stabilisation of polyamide fibre material, which comprises treating said fibre material with a composition comprising a water-soluble oxalic acid diamide having fibre-affinity of general formula

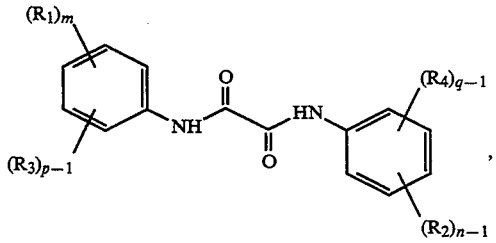

(1)

wherein $R_1$ and $R_2$ are each independently of the other hydrogen, unsubstituted $C_1$–$C_{18}$alkoxy or $C_1$–$C_{18}$alkoxy which is substituted by halogen, hydroxy, $C_1$–$C_5$alkoxy, carboxyl groups, carbamyl groups or $C_1$–$C_{12}$alkoxycarbonyl groups, or is $C_3$–$C_5$alkenyloxy, unsubstituted benzyloxy or benzyloxy which is substituted by halogen or $C_1$–$C_5$alkyl, aliphatic acyloxy containing up to 18 carbon atoms, unsubstituted benzoyloxy or benzoyloxy which is substituted by halogen or $C_1$–$C_4$alkyl, or is a radical of formula —A—$SO_3M$, A is a direct bond or a divalent radical of formula —O—Q—, and Q is unsubstituted or hydroxy-substituted $C_1$–$C_6$alkylene, M is hydrogen or alkali metal, $R_3$ and $R_4$ are each independently of the other hydrogen, halogen, $C_1$–$C_{12}$alkyl, haloalkyl, phenyl or phenyl-$C_1$–$C_5$alkyl, or two radicals $R_3$ and/or $R_4$ in ortho-position each together form a fused 6-membered aromatic carbon ring, and wherein m and n are 1 or 2 and p and q are 1, 2 or 3, and with the proviso that the compound of formula (1) contains at least one sulfo group, and a copper complex of formula

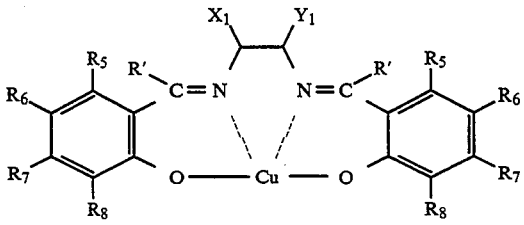

(2)

wherein

R' is hydrogen or $C_1$–$C_5$alkyl, $R_5$, $R_6$, $R_7$ and $R_8$ are each hydrogen, halogen, hydroxy, hydroxyalkyl, $C_1$–$C_5$alkyl, $C_1$–$C_5$alkoxy, alkoxyalkoxy, alkoxyalkoxyalkoxy, carboxymethoxy, alkylamino, dialkylamino, —$SO_2NH_2$, —$SO_2NHR$, sulfo or —$SO_2N(R)_2$, R is $C_1$–$C_5$alkyl or $C_1$–$C_5$alkoxyalkyl or $R_5$ and $R_6$ or $R_6$ and $R_7$ or $R_7$ and $R_8$, together with the linking carbon atoms, are a benzene radical, $X_1$ and $Y_1$ are each hydrogen, $C_1$–$C_5$alkyl or an aromatic radical, or $X_1$ and $Y_1$, together with the linking carbon atoms, form a cycloaliphatic radical of 5–7 carbon atoms, or a copper complex of formula

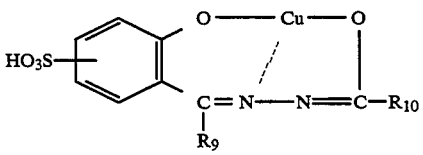

(3)

wherein $R_9$ and $R_{10}$ are each independently of the other an unsubstituted or substituted $C_1$–$C_5$alkyl or aryl radical, or a copper complex of phenols of formula

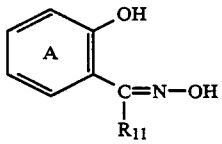

(4)

wherein $R_{11}$ is hydrogen, hydroxy, alkyl or cycloalkyl, and the ring A may carry further substituents.

In the definition of the substituents R, R' and $R_1$ to $R_8$ $C_1$–$C_5$alkyl and $C_1$–$C_5$alkoxy denote those groups or moieties which contain 1 to 5, preferably 1 to 3, carbon atoms. Typical examples of such groups are methyl, ethyl, n-propyl, isopropyl, n-butyl, sec-butyl, tert-butyl, amyl or isoamyl and, respectively, methoxy, ethoxy, isopropoxy, isobutoxy, tert-butoxy or tert-amyloxy.

In addition to the radicals cited above in connection with $C_1$–$C_5$alkoxy, $C_1$–$C_{12}$alkoxy may be pentyloxy, hexyloxy, heptyloxy, octyloxy, nonyloxy, decyloxy, undecyloxy, dodecyloxy or the corresponding isomers thereof.

The $C_1$–$C_{18}$alkyl radicals in the definition of $R_1$ and $R_2$ and the $C_1$–$C_{12}$alkyl radicals in the definition of $R_3$ and $R_4$ may be branched or unbranched. Typical examples are the representatives defined for $C_1$–$C_5$alkyl as well as alkyl radicals containing a greater number of carbon atoms, including pentyl, neopentyl, tert-pentyl, hexyl, isohexyl, heptyl, octyl, isooctyl, nonyl, decyl, undecyl, dodecyl, tridecyl, tetradecyl, pentadecyl, hexadecyl, heptadecyl or octadecyl.

$C_1$–$C_6$Alkylene in the definition of Q is a divalent saturated hydrocarbon radical such as methylene, ethylene, propylene, trimethylene, tetramethylene, ethylethylene, pentamethylene or hexamethylene.

Phenyl-$C_1$–$C_5$alkyl is typically phenethyl, phenylpropyl, phenylbutyl or preferably benzyl.

Halogen is fluoro, bromo or, preferably, chloro.

Exemplary of alkali metals defined as M are lithium, sodium or potassium. Sodium is preferred.

$R_5$ to $R_8$ as hydroxyalkyl is typically hydroxyethyl. Alkoxyalkoxy is suitably methoxyethoxy (also termed 2-oxabutoxy,—O—$CH_2$—$CH_2$—O—$CH_3$). Alkoxyalkoxyalkoxy is suitably ethoxyethoxyethoxy (also termed 3,6-dioxaoctyloxy, —O—$CH_2$—$CH_2$—O—$CH_2$—$CH_2$—O—$CH_2$—$CH_3$) and dialkylamino is suitably diethylamino. Sulfamoyl radicals are preferably sulfamoyl, N-methylsulfamoyl and N,N-dimethylsulfamoyl.

Two adjacent substituents $R_5$ to $R_8$, together with the linking carbon atoms, may also form a fused benzene ring. Such bisazomethines are derived from 2-hydroxy-2-naphthaldehyde, 3-hydroxy-2-naphthaldehyde or 1-hydroxy-2-naphthaldehyde.

Suitable aromatic radicals $X_1$ and $Y_1$ are preferably unsubstituted or substituted naphthyl and, more particularly, phenyl radicals. In addition, $X_1$ and $Y_1$ may be linked to form a cycloaliphatic radical such as cyclopentylene, cyclohexylene or cycloheptylene.

$R_{10}$ defined as aryl in formula (3) is naphthyl or, preferably, phenyl.

In the process of this invention it is preferred to use an oxalic acid diarylamide of general formula (5)

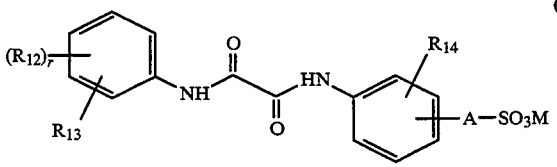

wherein $R_{12}$ is unsubstituted $C_1$–$C_5$alkyloxy or $C_1$–$C_5$alkyloxy which is substituted by hydroxy or $C_1$–$C_5$alkoxy, unsubstituted benzyloxy or $C_1$–$C_5$alkyl-substituted benzyloxy, or a radical of formula —A—$SO_3M$, $R_{13}$ and $R_{14}$ are each independently of the other hydrogen, halogen, $C_1$–$C_{12}$alkyl or phenyl-$C_1$–$C_5$alkyl, r is 1 or0, and A and M are as defined for formula (1).

Preferred compounds are those in which Q is ethylene, trimethylene or $$-CH_2-\underset{\underset{OH}{|}}{CH}-CH_2-.$$

Particularly preferred oxalic acid diarylamides are those of formula (6)

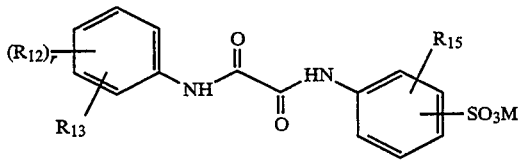

wherein $R_{15}$ is $C_1$–$C_{12}$alkyl and $R_{12}$, $R_{13}$, M and r are as defined for formula (5).

Particularly important oxalic acid diarylamides are those of formula (7)

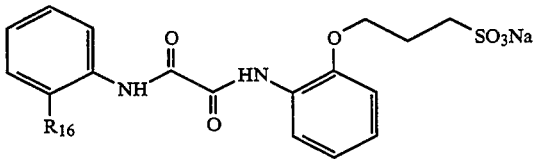

or of formula (8)

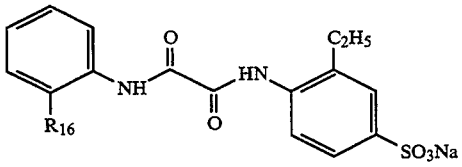

wherein $R_{16}$ is ethyl or ethoxy.

Preferred copper complexes which are used in the process of this invention are those of formula (9)

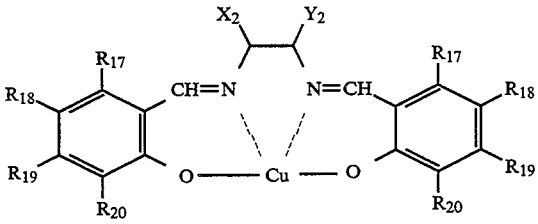

wherein $R_{17}$ to $R_{20}$ are each independently of one another hydrogen, hydroxy, bromo, methyl, tert-butyl, methoxy, methoxyethoxy, ethoxyethoxyethoxy or diethylamino, $X_2$ is hydrogen, methyl, ethyl, or phenyl and $Y_2$ is hydrogen, or $R_{19}$ and $R_{20}$ together form a fused benzene ring or $X_2$ and $Y_2$ together form a cyclohexylene radical.

Copper complexes meriting particular interest are those of formula (9), wherein $R_{17}$, $R_{18}$, $R_{19}$, $R_{20}$, $X_2$ and $X_3$ are hydrogen.

In the process of this invention it is preferred to use compositions which comprise an oxalic acid diarylamide of formula (5) and a copper complex of formula (9).

Particularly interesting compositions are those which comprise an oxalic acid diarylamide of formula (7) and a copper complex of formula (9), or compositions which comprise an oxalic acid diarylamide of formula (8) and a copper complex of formula (9), wherein $R_{17}$, $R_{18}$, $R_{19}$, $R_{20}$, $X_2$ and $X_3$ are hydrogen.

The invention further relates to the compositions used in the novel process for the photochemical and thermal stabilisation of polyamide fibre material, which compositions comprise a water-soluble oxalic acid diarylamide having fibre-affinity of general formula

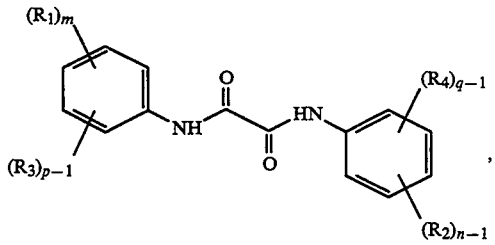

(1)

wherein $R_1$ and $R_2$ are each independently of the other hydrogen, unsubstituted $C_1$–$C_{18}$alkoxy or $C_1$–$C_{18}$alkoxy which is substituted by halogen, hydroxy, $C_1$–$C_5$alkoxy, carboxyl groups, carbamyl groups or $C_1$–$C_{12}$alkoxycarbonyl groups, or is $C_3$–$C_5$alkenyloxy, unsubstituted benzyloxy or benzyloxy which is substituted by halogen or $C_1$–$C_5$alkyl, aliphatic acyloxy containing up to 18 carbon atoms, unsubstituted benzoyloxy or benzoyloxy which is substituted by halogen or $C_1$–$C_4$alkyl, or is a radical of formula —A—$SO_3M$, A is a direct bond or a divalent radical of formula —O—Q—, and Q is unsubstituted or hydroxy-substituted $C_1$–$C_6$alkylene, M is hydrogen or alkali metal, $R_3$ and $R_4$ are each independently of the other hydrogen, halogen, $C_1$–$C_{12}$alkyl, haloalkyl, phenyl or phenyl-$C_1$–$C_5$alkyl, or two radicals $R_3$ and/or $R_4$ in ortho-position each together form a fused 6-membered aromatic carbon ring, and wherein m and n are 1 or 2 and p and q are 1, 2 or 3, and with the proviso that the compound of formula (1) contains at least one sulfo group, and a copper complex of formula

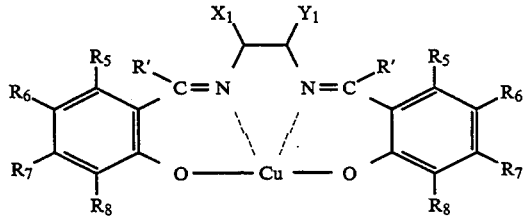

(2)

wherein

R' is hydrogen or $C_1$–$C_5$alkyl, $R_5$, $R_6$, $R_7$ and $R_8$ are each hydrogen, halogen, hydroxy, hydroxyalkyl, $C_1$–$C_5$alkyl, $C_1$–$C_5$alkoxy, alkoxyalkoxy, alkoxyalkoxyalkoxy, carboxymethoxy, alkylamino, dialkylamino, —$SO_2NH_2$, —$SO_2NHR$, sulfo or —$SO_2N(R)_2$, R is $C_1$–$C_5$alkyl or $C_1$–$C_5$alkoxyalkyl or $R_5$ and $R_6$ or $R_6$ and $R_7$ or $R_7$ and $R_8$, together with the linking carbon atoms, are a radical of the benzene series, $X_1$ and $Y_1$ are each hydrogen, $C_1$–$C_5$alkyl or an aromatic radical, or $X_1$ and $Y_1$, together with the linking carbon atoms, form a cycloaliphatic radical of 5–7 carbon atoms, or a copper complex of formula

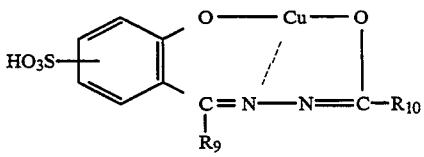

(3)

wherein $R_9$ and $R_{10}$ are each independently of the other an unsubstituted or substituted $C_1$–$C_5$alkyl or aryl radical, or a copper complex of phenols of formula

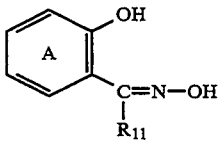

(4)

wherein $R_{11}$ is hydrogen, hydroxy, alkyl or cycloalkyl, and the ring A may carry further substituents.

Suitable compositions are preferably those which comprise an oxalic acid diarylamide of formula (5) and a copper complex of formula (9).

Some of the oxalic acid diarylamides used in the process of this invention are known compounds and some are also novel compounds. They are prepared by methods which are known per se, for example as described in U.S. Pat. No. 3,529,982. The compound is obtained by amidating, in the first step, oxalic acid or an ester thereof in per se known manner by the reaction of oxalic acid or an ester thereof, preferably an alkyl ester, with an approximately equimolar amount of the corresponding aniline. A preferred method typically comprises condensing oxalic acid, the partial ester or diester of oxalic acid carrying similar or different ester groups with an approximately molar amount of the aniline compound in the melt or in organic solvents which are inert to the reactants, in the presence of anhydrous boric acid and in the temperature range from about 50° to 200° C. After isolation of the resultant amide ester or amide acid, the still remaining carboxyl or carboxylate group of the oxalic acid partial amide is condensed under similar conditions with a second aniline which differs from that of the first step, conveniently choosing a temperature range which is 50° to 100° C. higher and is in the range from about 100° to 250° C. Approximate equimolar amounts of reactants are also used for this reaction.

Suitable inert organic solvents mentioned above are preferably those whose boiling point is above c. 160° C., i.e. conveniently higher aromatic hydrocarbons or halogenated hydrocarbons such as dichlorobenzene or trichlorobenzene.

The introduction of the second amide group can alternatively also be effected by partial saponification of the amide ester obtained in the first step to the amide acid, converting said amide acid into the amide acid halide and subsequently amidating the acid halide group.

The oxalic acid diarylamide so obtained which still contains free hydroxyl groups is subsequently etherified in known manner.

The copper complexes of general formulae (2) to (4) are disclosed, inter alia, in EP-A-0 051 188, EP-A-0 113

856 und EP-A-0 162 811 and can be prepared by known methods.

The novel composition comprising an oxalic acid diarylamide of formula (1) and a copper complex of formula (2), (3) or (4) is applied in the practice of this invention from an aqueous bath. The amount of compound added will depend on the substrate and the desired stabilisation. Normally 0.005 to 1.0% by weight, preferably 0.05 to 0.5% by weight, of the copper complex and 0.05 to 10% by weight, preferably 0.1 to 5.0% by weight, of the oxalic acid diarylamide, in each case based on the substrate, is added.

If the copper complexes are water-insoluble, they are conveniently added as fine dispersions which are obtained by milling in the presence of customary dispersants.

The application of the novel composition can be made before, after or preferably during dyeing, by an exhaust process at liquor ratios of 1:5 to 1:500, preferably 1:10 to 1:50. The compound is conveniently added to the dyebath.

The novel compound can also be applied continuously, for example by padding, by low application or high-temperature application systems.

In the continuous process, the liquor is conveniently applied to a pick-up of 30–400% by weight, preferably 75–250% by weight. For fixation of the dyes and the novel composition the fibre material is subjected to a heat treatment. The fixation process can also be carried out by the cold pad-batch method.

The heat treatment is preferably carried out by steaming by treatment in a steamer with steam or superheated steam in the temperature range from 98°–105° C. for conveniently 1 to 7, preferably 1 to 5, minutes. The fixation of the dyes, the oxalic diarylamide and the copper complex compound by the cold pad-batch method can be effected by storing the impregnated and preferably rolled up goods at room temperature (15° to 30° C.), conveniently for 3 to 24 hours, the cold batching time depending naturally on the type of dye used.

When the dyeing process and fixation is complete, the dyeings are rinsed and dried in conventional manner.

The novel composition comprising an oxalic acid diarylamide and a copper complex is used for the photochemical and thermal stabilisation of polyamide fibre materials and the dyeings produced thereon. In application it is distinguished by superior light stability and good fibre affinity, and imparts enhanced photochemical stability to the fibre materials treated with these compounds.

Polyamide fibre material will be understood as meaning in the context of this invention synthetic polyamide, typically polyamide 6, polyamide 66 or also polyamide 12. In addition to pure polyamide fibres, fibre blends such as polymide 6/wool or polyurethane/polyamide blends, for example tricot material made from polyamide/polyurethane in the ratio 70:30, are also suitable. Polypropylene/polyamide blends can also suitably be used. In principle, the pure polyamide material or blends thereof may be in various forms of presentation, including fibres, yarn, woven fabrics, knitted fabrics or carpets.

Polyamide material and also blends thereof with polyurethane or polypropylene which are exposed to the influence of light and heat, for example car upholstery, carpets or swim wear, are particulary suitable for treatment with the novel composition.

Dyeing is carried out in conventional manner conveniently with metal complex, anthraquinone or azo dyes and mixtures thereof. The metal complex dyes used are the known types, preferably the 1:2 chromium or 1:2 cobalt complexes of monoazo or disazo or azomethine dyes which are described in profusion in the literature. In addition to these dyes, dyes of other classes, such as disperse or also reactive dyes, may also suitably be used.

The invention is illustrated by the following Working and Use Examples in which parts and percentages are by weight. Unless otherwise indicated, the percentages of the ingredients of the individual dyebaths and treatment baths are based on the fibre material.

PREPARATION OF THE NOVEL OXALIC ACID DIARYLAMIDES

EXAMPLE 1

A solution of 1.75 g (14.3 mmol) of 1,3-propanesultone and 50 ml of acetone is added to a suspension of 4.9 g (14.3 mol) of the sodium salt of 2-ethoxy-2'-hydroxyoxalic acid dianilide (prepared by crystallisation of 2-ethoxy-2'-hydroxy-dianilide in aqueous sodium hydroxide) and 200 ml of acetone. After heating for 1 hour under reflux and subsequent cooling, the precipitate is filtered with suction and dried. Yield: 5.45 g of the compound of formula (101)

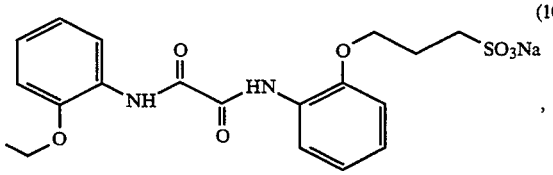

which is recrystallised from ethanol/water (8:2) to give a colourless substance.

Yield 86%; m.p. 236°–238° C. Elemental analysis for $C_{19}H_{21}N_2O_7SNa.0,25\ H_2O$: found: 50.91% C; 4.83% H; 6.30% N; 7.08% S calcd: 50.87% C; 4.75% H; 6.24% N; 7.14% S

EXAMPLE 2

8.02 g (38 mmol) of sodium 2-ethylsulfanilate are added at 100° C. to a melt of 9.48 g (40 mmol) of 2-ethoxyoxalic acid anilide monoethyl ester and 5.44 g of imidazole. The reaction mixture is heated for ½ hour to 110° C., then for 2 hours to 130° C. After cooling, the reaction mass is charged into 200 ml of water. The precipitate is filtered with suction, washed with 50 ml of ice-water and dried, giving 6.95 g of the compound of formula (103)

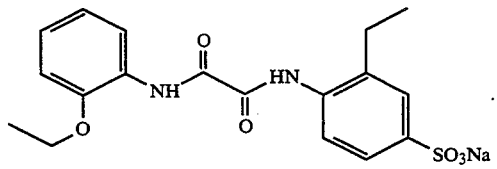

Yield: 44%; m.p.>300° C. Elemental analysis for $C_{18}H_{19}N_2O_6SNa.0,25\ H_2O$: found: 51.6% C; 4.7% H; 6.8% N; 7.5% S calcd: 51.6% C; 4.69% H; 6.68% N; 7.65% S

EXAMPLES 3 TO 28

Preparation of Compounds (103) to (106), (109) to (113) and (116) to (128)

In accordance with the general procedure of Example 2, 38 mmol of unsubstituted or substituted sulfanilic or metanilic acid are added at 100° C. to a melt of 40 mml of substituted oxalic acid anilide monoalkyl ester and 80 to 200 mml of imidazole. The reaction mixture is heated for ½ hour to 110° C., then for 1 to 3 hours to 130° C. The completion of the reaction is determined by thin-layer chromatography. After cooling, the reaction mass is charged into c. 200 ml of water. The precipitate is filtered with suction, washed with water and dried. Acetone is used instead of water for working up compounds (103) and (104), and ethanol for working up compounds (105), (106) and (113). The yields are reported in Table I.

Preparation of Compound (115)

4.2 g (21.4 mmol) of a 30% methanolic solution of sodium methylate and 4.42 g (21.4 mmol) of sodium 3-chloro-2-hydroxypropanesulfonate are added to a solution of 4.51 g (14.25 mmol) of 2,5-dimethoxy-4'-hydroxyoxalic acid dianilide and 100 ml of dimethyl formamide. After stirring for 15 hours at 150° C., the precipitate (NaCl) is removed by filtration and the filtrate is concentrated by evaporation at 75° C./0.13 Pa. The residue is taken up in water. After addition of sodium chloride, the precipitated crude product is filtered with suction and recrystallised from dimethyl formamide/ethanol, giving 3.8 g of a white powder.

Preparation of Compound (108)

The compound is prepared in accordance with the general procedure for obtaining compound (115) by reacting 2-ethoxy-2'-hydroxyoxalic acid dianilide.

Preparation of Compounds (107), (114) and (121)

The compounds are prepared in accordance with the general procedure described in Example 1.

Preparation of the Starting Compound for Compounds (114) and (115) 2,5-dimethoxy-4'-hydroxyoxalic acid dianilide 5.07 g (20 mmol) of 2,5-dimethoxyoxalic acid anilide monomethyl ester und 2 g (18 mmol) of 4-aminophenol are heated to 150° C. in the presence of catalytic amounts of boron trifluoride under a slight vacuum, and the alcohol formed is removed by distillation. After 5.5 hours the reaction mixture is cooled and 40 ml of ethanol are added. Crystallisation at −5° C. to give 3.4 g of crude product which is purified by washing with hot trichlorethylene.

m.p. 204°–205° C. Elemental analysis for $C_{16}H_{16}N_2O_5$: found: 60.58% C; 5.19% H; 8.88% N; calcd: 60.75% C; 5.1% H; 8.86% N;

Preparation of the Starting Compound for Compound (121) 2-methoxy-5-methyl-4'-hydroxyoxalic acid dianilide 8.3 g (41.5 mmol) of 4-hydroxyoxalic acid anilide monoethyl ester and 6.85 g (50 mmol) of 2-methoxy-5-methylaniline are heated under a slight vacuum to 130° C. and the alcohol formed is removed by distillation. After 7 hours the reaction mixture is cooled and stirred with acetone. Insoluble by-product is removed by filtration, and the filtrate is poured into 130 ml of water to precipitate the product.

Yield: 6.27 g m.p. 189°–190° C. Elemental analysis for $C_{16}H_{16}N_2O_4$: found: 64.0% C; 5.4% H; 9.4% N; calcd: 63.99% C; 5.3% H; 9.32% N;

TABLE I

| Compound No. | R | Yield [%] | Elemental analysis |
|---|---|---|---|
| | 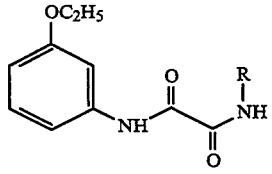 | | |
| (103) | 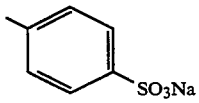 | 53 | $C_{16}H_{15}N_2O_6SNa$<br>found: 49.68% C; 4.11% H; 7.28% N; 7.84% S<br>calcd: 49.74% C; 3.91% H; 7.25% N; 8.3% S |
| (104) | 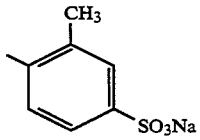 | 62 | $C_{17}H_{17}N_2O_6SNa$<br>found: 50.99% C; 4.14% H; 7.16% N; 7.90% S<br>calcd: 51.00% C; 4.28% H; 7.00% N; 8.01% S |
| (105) | 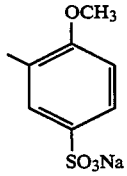 | 81 | $C_{17}H_{17}N_2O_7SNa$<br>found: 47.72% C; 4.32% H; 6.69% N; 7.40% S<br>calcd: 47.66% C; 4.31% H; 6.54% N; 7.48% S |

TABLE I-continued

| Compound No. | R | Yield [%] | Elemental analysis |
|---|---|---|---|
| (106) | 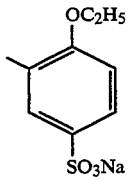 | 71 | $C_{18}H_{19}N_2O_7SNa.\frac{1}{4}H_2O$<br>found: 49.39% C; 4.52% H; 6.77% N; 7.35% S<br>calcd: 49.70% C; 4.51% H; 6.44% N; 7.37% S |
| (107) | 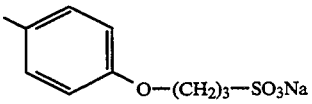 | 93 | $C_{19}H_{21}N_2O_7SNa$<br>found: 51.01% C; 4.82% H; 6.35% N; 7.9% S<br>calcd: 51.35% C; 4.76% H; 6.30% N; 7.21% S |
| (108) | 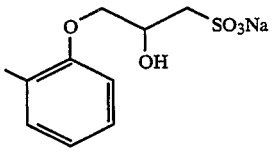 | 37 | $C_{19}H_{21}N_2O_8SNa.H_2O$<br>found: 47.70% C; 4.70% H; 6.00% N; 7.20% S<br>calcd: 47.69% C; 4.84% H; 5.89% N; 6.70% S |
| | 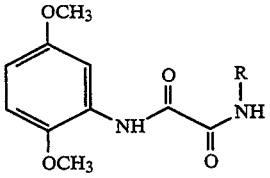 | | |
| (109) | 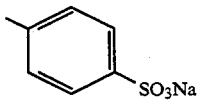 | 44 | $C_{16}H_{15}N_2O_7SNa$<br>found: 47.48% C; 3.82% H; 6.95% N; 7.86% S<br>calcd: 47.76% C; 3.76% H; 6.96% N; 7.97% S |
| (110) | 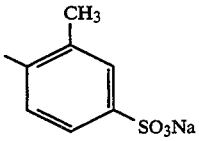 | 52 | $C_{17}H_{17}N_2O_7SNa.\frac{1}{4}H_2O$<br>found: 48,40% C; 4,10% H; 6.80% N; 7.40% S<br>calcd: 48.51% C; 4.19% H; 6.65% N; 7.61% S |
| (111) | 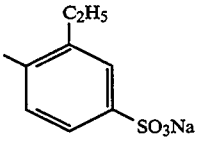 | 35 | $C_{18}H_{19}N_2O_6SNa.\frac{1}{4}H_2O$<br>found: 51.60% C; 4.70% H; 6.80% N; 7.50% S<br>calcd: 51.60% C; 4.69% H; 6.68% N; 7.65% S |
| (112) | 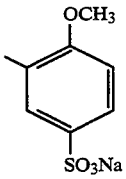 | 69 | $C_{17}H_{17}N_2O_8SNa$<br>found: 47.02% C; 4.06% H; 6.86% N; 7.05% S<br>calcd: 47.22% C; 3.96% H; 6.47% N; 7.41% S |
| (113) | 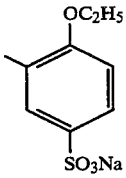 | 87 | $C_{18}H_{19}N_2O_8SNa$<br>found: 48.00% C; 4.30% H; 6.60% N; 6.80% S<br>calcd: 48.43% C; 4.29% H; 6.28% N; 7.18% S |
| (114) | 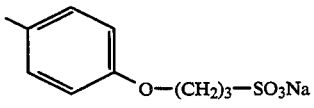 | 98 | $C_{19}H_{21}N_2O_8SNa.\frac{1}{2}H_2O$<br>found: 48.53% C; 4.50% H; 5.98% N; 6.79% S<br>calcd: 48.61% C; 4.72% H; 5.96% N; 6.82% S |

TABLE I-continued

| Compound No. | R | Yield [%] | Elemental analysis |
|---|---|---|---|
| (115) | 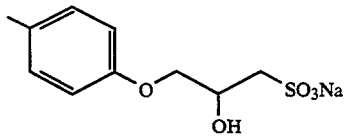 | 56 | $C_{19}H_{21}N_2O_9SNa$<br>found: 47.87% C; 4.64% H; 6.02% N; 6.64% S<br>calcd: 47.90% C; 4.44% H; 5.88% N; 6.73% S |
| | 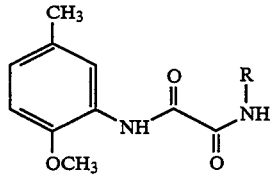 | | |
| (116) | 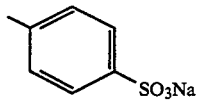 | 40 | $C_{16}H_{15}N_2O_6SNa$<br>found: 49.40% C; 4.00% H; 7.30% N; 8.30% S<br>calcd: 49.74% C; 3.91% H; 7.25% N; 8.29% S |
| (117) | 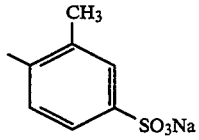 | 62 | $C_{17}H_{17}N_2O_6SNa.\frac{1}{3}H_2O$<br>found: 50.20% C; 4.40% H; 7.10% N; 8.00% S<br>calcd: 50.20% C; 4.38% H; 6.89% N; 7.89% S |
| (118) | 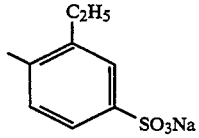 | 35 | $C_{18}H_{19}N_2O_6SNa.\frac{1}{4}H_2O$<br>found: 51.76% C; 4,72% H; 6.82% N; 7.65% S<br>calcd: 51.60% C; 4.69% H; 6.68% N; 7.65% S |
| (119) | 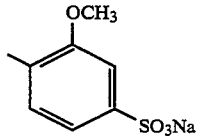 | 38 | $C_{17}H_{17}N_2O_7SNa.2\frac{3}{4}H_2O$<br>found: 46.57% C; 4.59% H; 6.59% N; 7.30% S<br>calcd: 46.52% C; 4.48% H; 6.38% N; 7.30% S |
| (120) | 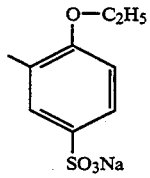 | 68 | $C_{18}H_{19}N_2O_7SNa.\frac{1}{2}H_2O$<br>found: 49.27% C; 4.60% H; 6.49% N; 7.34% S<br>calcd: 49.20% C; 4.59% H; 6.37% N; 7.29% S |
| (121) | 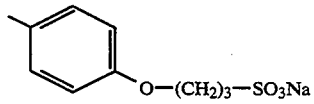 | 69 | $C_{19}H_{21}N_2O_7SNa\frac{1}{2}H_2O$<br>found: 51.00% C; 4.80% H; 6.30% N; 7.20% S<br>calcd: 51.35% C; 4.76% H; 6.30% N; 7.21% S |
| | 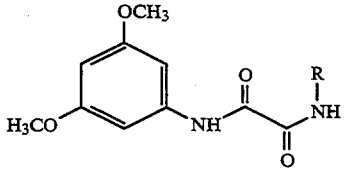 | | |
| (122) | 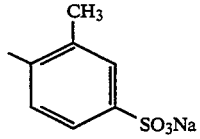 | 58 | $C_{17}H_{17}N_2O_7SNa$<br>found: 48.70% C; 4.10% H; 6.80% N; 7.60% S<br>calcd: 49.00% C; 4.12% H; 6.73% N; 7.70% S |

TABLE I-continued

| Compound No. | R | Yield [%] | Elemental analysis |
|---|---|---|---|
| (123) | 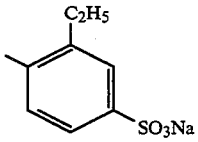 | 46 | $C_{18}H_{19}N_2O_7SNa$<br>found: 50.20% C; 4.40% H; 6.60% N; 7.50% S<br>calcd: 50.23% C; 4.45% H; 6.51% N; 7.45% S |
| (124) | 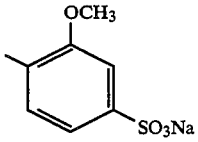 | 75 | $C_{17}H_{17}N_2O_8SNa.\frac{1}{4}H_2O$<br>found: 46.63% C; 4.06% H; 6.55% N; 7.14% S<br>calcd: 46.73% C; 4.03% H; 6.41% N; 7.33% S |
| (125) | 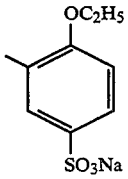 | 40 | $C_{18}H_{19}N_2O_8SNa$<br>found: 48.29% C; 4.42% H; 6.41% N; 7.06% S<br>calcd: 48.43% C; 4.29% H; 6.28% N; 7.18% S |
| | 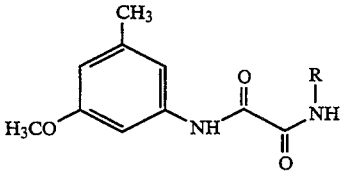 | | |
| (126) | 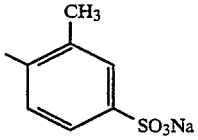 | 43 | $C_{17}H_{17}N_2O_6SNa$<br>found: 50.80% C; 4.4% H; 7.2% N; 8.20% S<br>calcd: 51.00% C; 4.28% H; 7.00% N; 8.01% S |
| (127) | 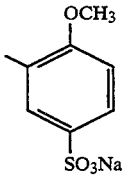 | 55 | $C_{17}H_{17}N_2O_7SNa$<br>found: 49.10% C; 4.20% H; 7.00% N; 7.70% S<br>calcd: 49.04% C; 4.12% H; 6.73% N; 7.70% S |
| (128) | 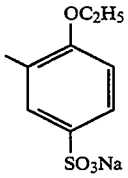 | 73 | $C_{18}H_{19}N_2O_7SNa.\frac{1}{4}H_2O$<br>found: 49.60% C; 4.52% H; 6.54% N; 7.32% S<br>calcd: 49.71% C; 4.40% H; 6.44% N; 7.37% S |

USE EXAMPLES

EXAMPLE 29

Two 10 g samples of PA 6 knitgoods are dyed in an ®AHIBA dyeing machine at a liquor ratio of 1:25. Both dyebaths contain the following ingredients: 0.5 g/l of monosodium phosphate, 1.5 g/l of disodium phosphate and the dyes of formulae (I) and (II). All ingredients are dissolved before being added.

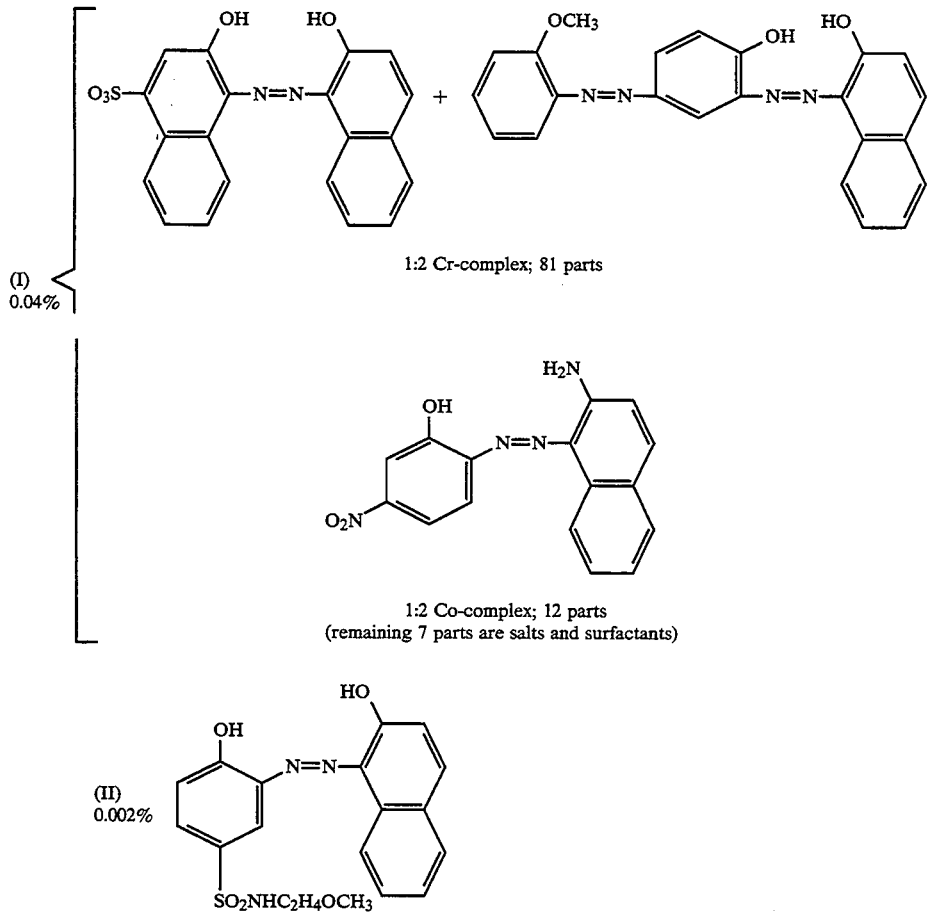

Whereas liquor 1 contains no further ingredients, 1% of the compound of formula (101), dissolved in water, is added to liquor 2. Liquor 3 contains, in addition to 1% of the compound of formula (101), 0.25% of a 20% dispersion (containing 20% of a condensate of naphthalenesulfonic acid and formaldehyde as dispersant) of the copper complex of formula (129)

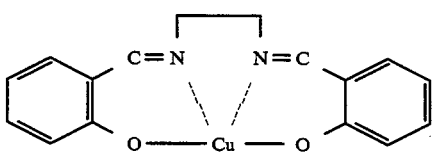

The textile materials are put into these liquors, which have been warmed to 40° C., and treated at this temperature for 10 minutes. The liquors are then heated at 2° C./minute to 95° C. After a dyeing time of 20 minutes at 95° C., 2% of acetic (80%) is added and dyeing is continued for another 25 minutes. After cooling to 60° C., the goods are rinsed with cold water, centrifuged, and then dried at 120° C. for 2 minutes.

The dyeings are tested for their lightfastness properties according to SN-ISO 105-B02 (=XENON) und DIN 75.202 (FAKRA). To determine the photochemical stabilisation, the dyed samples measuring 12×14.5 cm are mounted on cardboard and irradiated for 216 hours (=3 FAKRA cycles) according to DIN 75 202, and then tested for their tear strength according to SN 198.461. The results are reported in Table 2.

TABLE 2

| Addition to dye bath | Lightfastness XENON | 144 h FAKRA | 216 h FAKRA | Tear strength/stretch [%] after 216 h FAKRA |
|---|---|---|---|---|
| none (liquor 1) | 7 | 1H* | 1H* | 12.3/33.3 |
| +1% of compound of formula (101) (liquor 2) | 7 | 2 | 1–2 | 42.8/53.7 |
| +1% of compound of formula (101) +0.25% of compound of formula (129) (liquor 3) | 7–8 | 4–5 | 4–5 | 94.3/91.7 |

*Sample has only insignificant tear strength

The result shows not only the stabilising effect of the compound of formula (101) but also the increase in stability imparted by the compound of formula (129).

The lightfastness properties and tear strength are also determined as described in Example 1 with the following results (Table 3):

TABLE 3

| Addition to dye bath | Lightfastness XENON | 144 h FAKRA | 216 h FAKRA | Tear strength/ stretch [%] after 216 h FAKRA |
|---|---|---|---|---|
| +0.25% of compound of formula (129) (liquor 1) | 7 | 3 | 4 | 78.9/90.1 |
| +1% of compound of formula (102) +0.25% of compound of formula (129) (liquor 2) | 7–8 | 4–5 | 4–5 | 91.4/91.7 |

Here too it is evident that the stabilising effect of the compound of formula (102) is enhanced by the compound of formula (129).

EXAMPLE 31

3 pieces of PA 6 knitted goods are made ready and 3 liquors are prepared as described in Example 29, but without addition of dye (blank dyeing). Liquors 1 to 3 also contain 0.25% of a 20% dispersion of the compound of formula (129). Liquors 2 and 3 additionally contain the compounds of formulae

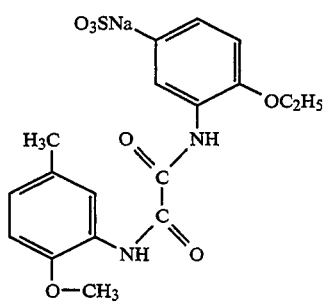

(125)

and

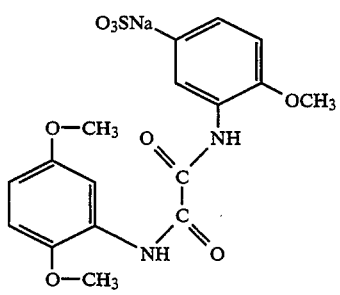

(112)

The textile material is exposed for 216 hours in these liquors to FAKRA light and tested for their tear strength and stretch according to SN 198 481. The following results are obtained (Table 4):

TABLE 4

| Addition to dye bath | Tear strenght/stretch [%] after 216 h FAKRA |
|---|---|
| +0.25% of compound of formula (129) (liquor 1) | 74.7/70.0 |
| +0.25% of compound of formula (129) +1% of compound of formula (125) (liquor 2) | 85.8/74.7 |
| +0,25% of compound of formula (129) +1% of compound of formula (112) (liquor 3) | 82.0/76.9 |

TABLE 4-continued

| Addition to dye bath | Tear strenght/stretch [%] after 216 h FAKRA |
|---|---|
| | |

EXAMPLE 32

4 samples of PA 66 tricot are made ready and a liquor is prepared as described in Example 29, except that liquor 1 contains no further additives and liquors 2 to 4 additionally contain 1% of the compounds of formulae

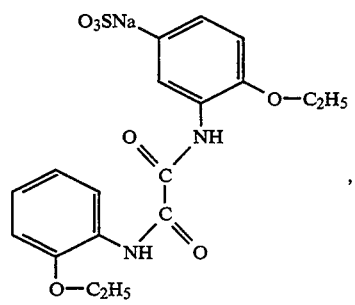

(106)

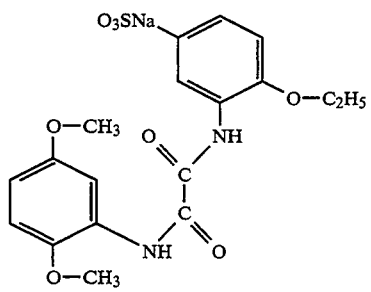

(113)

and

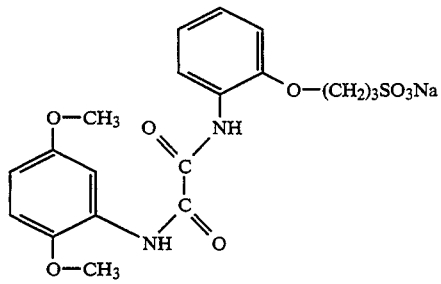

(114)

After exposure, the dyeings obtained are tested for their lightfastness and tear strength and stretch as described in Example 29. The results are reported in Table 5.

TABLE 5

| Addition to dye bath | Lightfastness 144 h FAKRA | Tear strenght/stretch [%] after 216 h FAKRA |
|---|---|---|
| none (liquor 1) | 3–4 | 73.8/63.6 |
| +1% of compound of formula (106) (liquor 2) | 4 | 84.6/66.9 |
| +1% of compound of formula (113) (liquor 3) | 4 | 81.4/66.0 |
| +1% of compound of formula (114) | 4 | 99.0/70.5 |

TABLE 5-continued

| Addition to dye bath | Lightfastness 144 h FAKRA | Tear strenght/stretch [%] after 216 h FAKRA |
|---|---|---|
| (liquor 4) | | |

It is evident from the results of the Table that compounds (106), (113) and (114) are further able to enhance markedly the stabilising effect of the copper complex.

What is claimed is:

1. A process for the photochemical and thermal stabilisation of polyamide fibre material, which comprises treating said fibre material with a composition comprising a water-soluble oxalic acid diamide having fibre-affinity of general formula

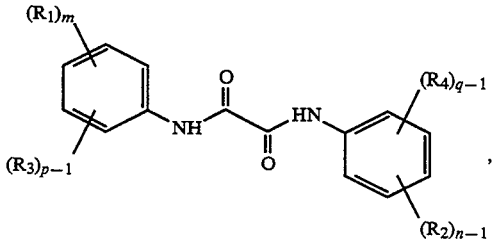

(1)

wherein $R_1$ and $R_2$ are each independently of the other hydrogen, unsubstituted $C_1$–$C_{18}$alkoxy or $C_1$–$C_{18}$alkoxy which is substituted by halogen, hydroxy, $C_1$–$C_5$alkoxy, carboxyl groups, carbamyl groups or $C_1$–$C_{12}$alkoxycarbonyl groups, or is $C_3$–$C_5$alkenyloxy, unsubstituted benzyloxy or benzyloxy which is substituted by halogen or $C_1$–$C_5$alkyl, aliphatic acyloxy containing up to 18 carbon atoms, unsubstituted benzoyloxy or benzoyloxy which is substituted by halogen or $C_1$–$C_4$alkyl, or is a radical of formula —A—$SO_3M$, A is a direct bond or a divalent radical of formula —O—Q—, and Q is unsubstituted or hydroxy-substituted $C_1$–$C_6$alkylene, M is hydrogen or alkali metal, $R_3$ and $R_4$ are each independently of the other hydrogen, halogen, $C_1$–$C_{12}$alkyl, haloalkyl, phenyl or phenyl-$C_1$–$C_5$alkyl, or two radicals $R_3$ and/or $R_4$ in ortho-position each together form a fused 6-membered aromatic carbon ring, and wherein m and n are 1 or 2 and p and q are 1, 2 or 3, and with the proviso that the compound of formula (1) contains at least one sulfo group, and a copper complex of formula

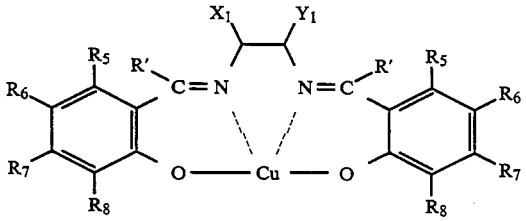

(2)

wherein

R′ is hydrogen or $C_1$–$C_5$alkyl, $R_5$, $R_6$, $R_7$ and $R_8$ are each hydrogen, halogen, hydroxy, hydroxyalkyl, $C_1$–$C_5$alkyl, $C_1$–$C_5$alkoxy, alkoxyalkoxy, alkoxyalkoxyalkoxy, carboxymethoxy, alkylamino, dialkylamino, —$SO_2NH_2$, —$SO_2NHR$, sulfo or —$SO_2N(R)_2$, R is $C_1$–$C_5$alkyl or $C_1$–$C_5$alkoxyalkyl or $R_5$ and $R_6$ or $R_6$ and $R_7$ or $R_7$ and $R_8$, together with the linking carbon atoms, are a radical of the benzene series, $X_1$ and $Y_1$ are each hydrogen, $C_1$–$C_5$alkyl or an aromatic radical, or $X_1$ and $Y_1$, together with the linking carbon atoms, form a cycloaliphatic radical of 5–7 carbon atoms, or a copper complex of formula

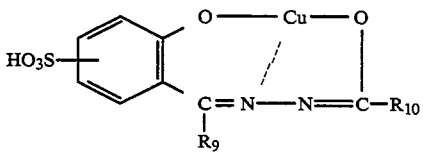

(3)

wherein $R_9$ and $R_{10}$ are each independently of the other an unsubstituted or substituted $C_1$–$C_5$alkyl or aryl radical, or a copper complex of phenols of formula

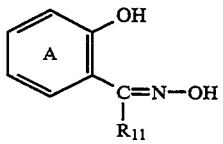

(4)

wherein $R_{11}$ is hydrogen, hydroxy, alkyl or cycloalkyl, and the ring A may carry further substituents.

2. A process according to claim 1, which comprises the use of an oxalic acid diarylamide of general formula

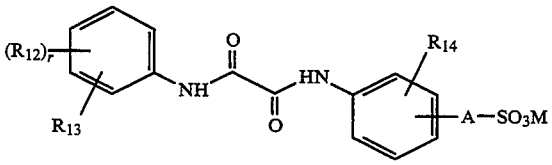

(5)

wherein $R_{12}$ is unsubstituted $C_1$–$C_5$alkyloxy or $C_1$–$C_5$alkyloxy which is substituted by hydroxy or alkoxy, unsubstituted benzyloxy or $C_1$–$C_5$alkyl-substituted benzyloxy, or a radical of formula —A—$SO_3M$, $R_{13}$ and $R_{14}$ are each independently of the other hydrogen, halogen, $C_1$–$C_{12}$alkyl or phenyl-$C_1$–$C_5$alkyl, r is 1 or 0, and A and M are as defined in claim 1.

3. A process according to claim 1, wherein Q is ethylene, trimethylene or $$-CH_2-\underset{\underset{OH}{|}}{CH}-CH_2-.$$

4. A process according to claim 2, wherein the oxalic acid diarylamide has the formula (6)

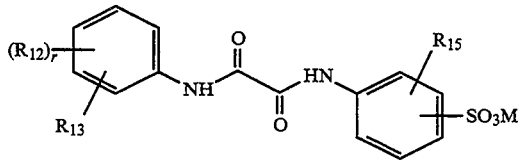

wherein $R_{15}$ is $C_1$–$C_{12}$alkyl, and $R_{12}$, $R_{13}$, M and r are as defined in claim 2.

5. A process according to claim 1, wherein the oxalic acid diarylamide has the formula (7)

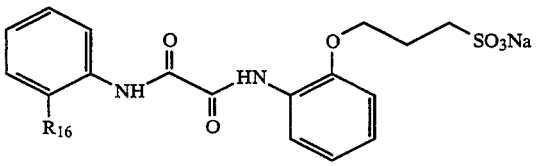

wherein $R_{16}$ is ethyl or ethoxy.

6. A process according to claim 1, wherein the oxalic acid diarylamide has the formula (8)

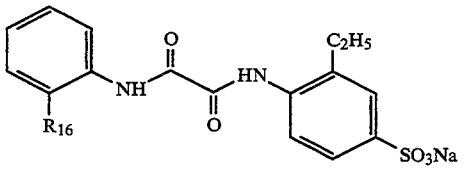

wherein $R_{16}$ is ethyl or ethoxy.

7. A process according to claim 1, which comprises the use of a copper complex of formula (9)

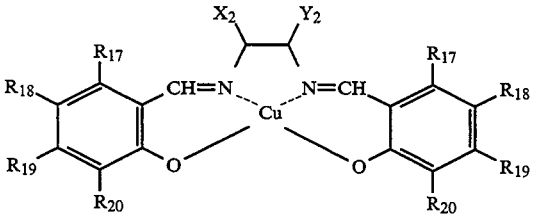

wherein $R_{17}$ to $R_{20}$ are each independently of one another hydrogen, hydroxy, bromo, methyl, tert-butyl, methoxy, methoxyethoxy, ethoxyethoxyethoxy or diethylamino, $X_2$ is hydrogen, methyl, ethyl, or phenyl and $Y_2$ is hydrogen, or $R_{19}$ and $R_{20}$ together form a fused benzene ring, or $X_2$ and $Y_2$ together form a cyclohexylene radical.

8. A process according to claim 7, which comprises the use of a copper complex of formula (9), wherein $R_{17}$, $R_{18}$, $R_{19}$, $R_{20}$, $X_2$ and $Y_2$ are hydrogen.

9. A process according to claim 1 wherein the composition comprises an oxalic acid diamide of general formula (5)

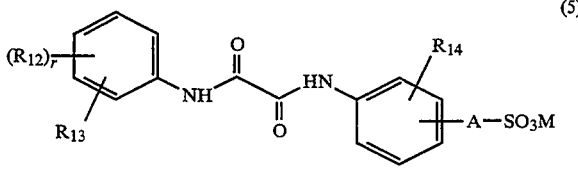

wherein $R_{12}$ is unsubstituted $C_1$–$C_5$alkyloxy or $C_1$–$C_5$alkyloxy which is substituted by hydroxy or alkoxy, unsubstituted benzyloxy or $C_1$–$C_5$alkyl-substituted benzyloxy, or a radical of formula —A—$SO_3M$, $R_{13}$ and $R_{14}$ are each independently of the other hydrogen, halogen, $C_1$–$C_{12}$alkyl or phenyl-$C_1$–$C_5$alkyl, r is 1 or 0, and a copper complex of formula (9)

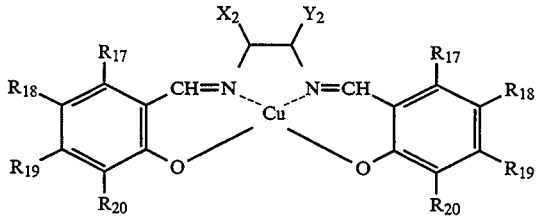

wherein $R_{17}$ to $R_{20}$ are each independently of one another hydrogen, hydroxy, bromo, methyl, tert-butyl, methoxy, methoxyethoxy, ethoxyethoxyethoxy or diethylamino, $X_2$ is hydrogen, methyl, ethyl, or phenyl and $Y_2$ is hydrogen, or $R_{19}$ and $R_{20}$ together form a fused benzene ring, or $X_2$ and $Y_2$ together form a cyclohexylene radical.

10. A process according to claim 1 wherein the composition comprises an oxalic acid diamide of the formula (7)

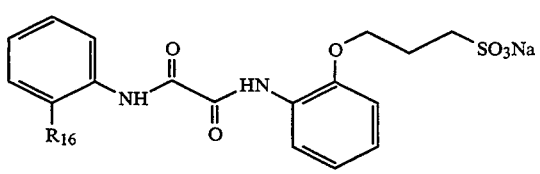

wherein $R_{16}$ is ethyl or ethoxy, and a copper complex of the formula (9)

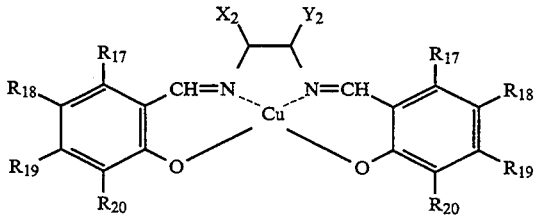

wherein $R_{17}$, $R_{18}$, $R_{19}$, $R_{20}$, $X_2$ and $Y_2$ are each hydrogen.

11. A process according to claim 1 wherein the composition comprises an oxalic acid diamide of the formula (8)

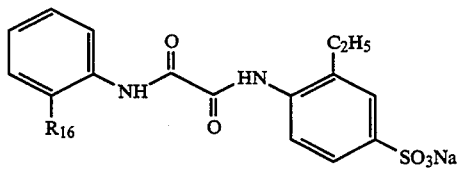

wherein $R_{16}$ is ethyl or ethoxy, and a copper complex of the formula (9)

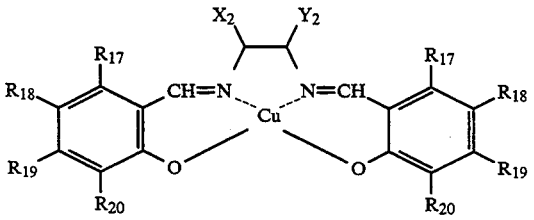

wherein $R_{17}$, $R_{18}$, $R_{19}$, $R_{20}$, $X_2$ and $Y_2$are each hydrogen.

12. A fiber material treated according to a process of claim 1.

13. A process of claim 1 wherein the composition comprises 0.005 to 1.0 percent by weight of the copper complex and 0.05 to 10 percent by weight of the oxalic acid diamide.

14. A process of claim 13 wherein the composition comprises 0.05 to 0.5 percent by weight of the copper complex and 0.1 to 5.0 percent by weight of the oxalic acid diamide.

15. A process of claim 1 wherein the composition is applied to the material from a bath by an exhaust process at a liquor ratio of from 1:5 to 1:500.

16. A process of claim 13 wherein the liquor ratio is from 1:10 to 1:50.

17. A process of claim 15 wherein the bath is a dyebath.

18. A process of claim 17 wherein the dyebath contains a dye or mixture of dyes selected from the group comprising of metal complex, anthraquinone and azo dyes.

19. A process of claim 16 wherein the bath is a dyebath.

20. A process of claim 19 wherein the dyebath contains a dye or mixture of dyes selected from the group consisting of metal complex, anthraquinone and azo dyes.

* * * * *